United States Patent [19]

Gundy

[11] Patent Number: 4,596,090

[45] Date of Patent: Jun. 24, 1986

[54] SPIGOT GRINDER AND GROOVER

[76] Inventor: William P. Gundy, 3 Cross Rd., Amherst, N.H. 03031

[21] Appl. No.: 605,463

[22] Filed: Apr. 30, 1984

[51] Int. Cl.[4] ..... B24B 5/12; B24B 1/00

[52] U.S. Cl. ..... 51/3; 51/290; 82/4 C

[58] Field of Search ..... 51/3, 290, 241 S, 241 B; 409/179; 125/10; 264/138, 154, 162; 82/4 C, 4 R

[56] References Cited

U.S. PATENT DOCUMENTS

| | | | |
|---|---|---|---|
| 2,159,287 | 5/1939 | Morgan | 51/241 B |
| 2,984,886 | 5/1961 | Jessen | 125/10 |
| 4,109,635 | 8/1978 | Rossborough | 51/241 B |
| 4,433,598 | 2/1984 | Murray | 82/4 C |

FOREIGN PATENT DOCUMENTS

| | | | |
|---|---|---|---|
| 0093642 | 11/1896 | Fed. Rep. of Germany | 82/4 R |
| 0151603 | 10/1981 | Fed. Rep. of Germany | 82/4 R |

*Primary Examiner*—Frederick A. Schmidt
*Assistant Examiner*—Robert A. Rose

[57] ABSTRACT

An apparatus and method for accurately grinding the outer circumferential face of the spigot of a bell, and spigot type member, such as a concrete pipe or manhole riser on one side of the spigot, while simultaneously cutting a sealing ring groove in that face on the opposite side of the spigot provides for advancing a support base and rotatable main arm assembly toward the end face of the member while automatically centering the support base on the outer circumferential face, then clamping in the centered position. A motor driven grinding assembly, on one side of the main arm assembly, and a motor driven cutter assembly, on the opposite side thereof, are then moved inwardly into contact with the spigot face, and the main arm assembly rotated in an annular path around the support base and member to grind a true truncated conical face on the spigot while the cutter forms an accurate sealing groove in that face for an O ring, or other seal. The centering is accomplished by opposite slave cylinders and pistons under control of a master cylinder, and the clamping is accomplished by a plurality of cylinder and piston devices.

9 Claims, 9 Drawing Figures

SPIGOT GRINDER AND GROOVER

BACKGROUND OF THE INVENTION

In the art of casting concrete pipe and concrete manhole risers, bell and spigot joints with O ring seals set in grooves in the spigot are much used to connect each separate element into a continuous sealed conduit or manhole.

However, it has long been a problem to produce a spigot with a true truncated conical circumferential outer face and having a true sealing groove, of uniform dimensions, extending annularly around that face because of flats, bumps, or slumps in the recently cast spigot portions.

It has heretofore been proposed, as in U.S. Pat. No. 2,984,886 to Jensen of May 23, 1961, to provide a circular skirt supported by rollers on the end face of an upended pipe, and rollers in contact with the outer face of the spigot, for centering a rotatable tool having blades for cutting a sealing groove around a "green" spigot and blades for chamfering the inner peripheral edge of the spigot. This device is hand turned, it accommodates only one size of spigot, and it does not grind the outerface of the spigot.

It has also been proposed, as in U.S. Pat. No. 4,109,635 to Rossborough of Aug. 29, 1978, to provide an assembly which rests on the end face of an upturned spigot and is centered on the longitudinal central axis thereof by manually adjustable internal and external guides. The outer face of the spigot and the sealing ring groove in the outer face are ground simultaneously by the same rotary cutter working on one side of the central axis as it progresses around the tracks of the assembly.

SUMMARY OF THE INVENTION

It has been found that the apparatus and method of the above mentioned U.S. Pat. No. 4,109,635 which manually centered on the spigot axis and cut face and groove simultaneously from one side of the spigot was not satisfactory for spigots which were not of true circular or symmetrical configuration to start with.

In this invention, therefore, centering is not based on the axis and not based on the inner face of the spigot, but is based on the outer face of the spigot which face is the part which must enter and seal in the bell of the adjacent bell and spigot member.

The centering is accomplished by power, automatically, as the support base of the apparatus approaches the end face of the spigot by means of two pairs of sensors, one sensor in each quadrant and each sensor of each pair having a slave cylinder, piston, and contact roller, the slave cylinders being connected to a master hydraulic cylinder. Thus, as the assembly approaches the end face, the four sensors are automatically centering it on the outer face of the spigot before it comes to rest.

Upon coming to rest in position precisely centered relative to the outer circumferential face of the spigot, the assembly is clamped in tight engagement against the end face and the sensors are withdrawn, so that the main arm assembly may rotate in a correct circle therearound.

The groove cutter and motor are mounted on one radially extending portion of the main arm assembly, and the face grinder and motor are mounted on the opposite side of the axis of rotation, on the other radially extending portion of the main arm assembly. Thus, instead of being cantilevered and unbalanced, the rotating main arm assembly is balanced as the grinder and cutter are moved toward each other under power to perform their function, as the assembly rotates around the spigot.

When the spigot is on a pipe and upended, the force of gravity holds the support base down on the end face and power actuated cylinder and piston clamps also are used to clamp the base to the inner wall of the pipe.

When the spigot is on a horizontally supported pipe or manhole riser, a similar set of power actuated cylinder and piston elements press the support base firmly against the end face so that it remains precisely centered during rotation of the main arm assembly therearound.

DESCRIPTION OF A PREFERRED EMBODIMENT

Figure 1:
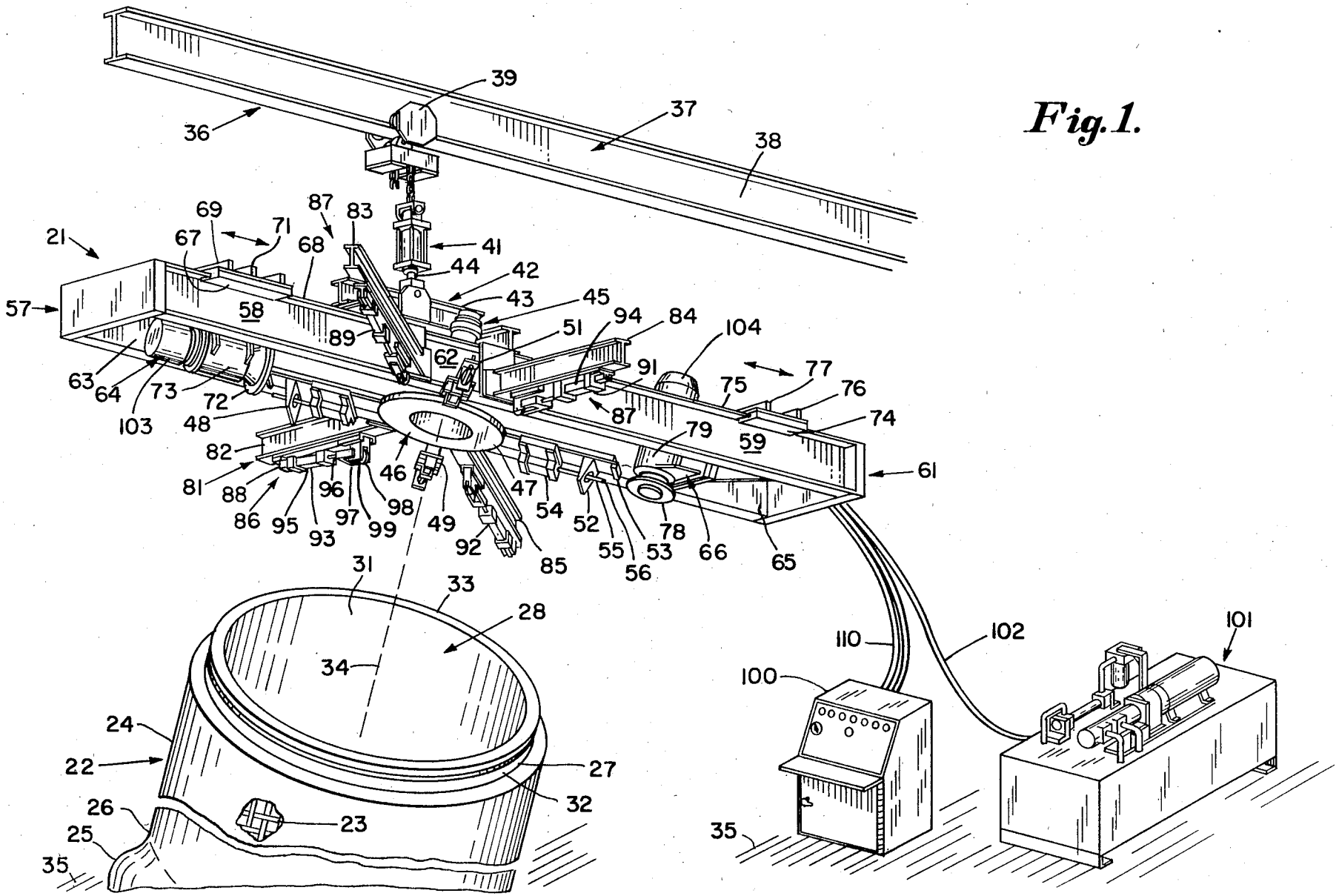
FIG. 1 is a diagrammatic, perspective view of the apparatus of the invention.
Figure 2:
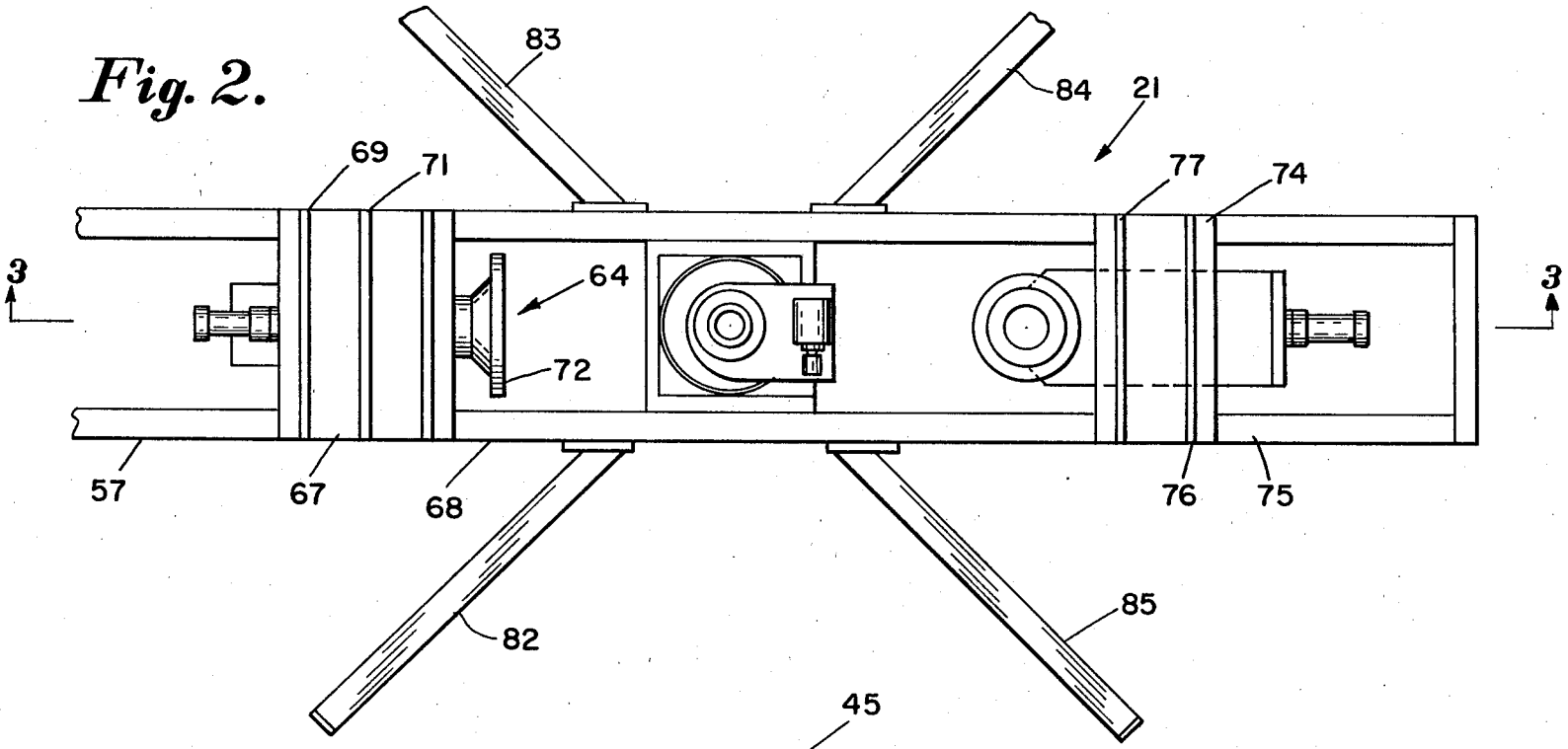
FIG. 2 is a top plan view of the main arm assembly and four radial centering arms.
Figure 3:
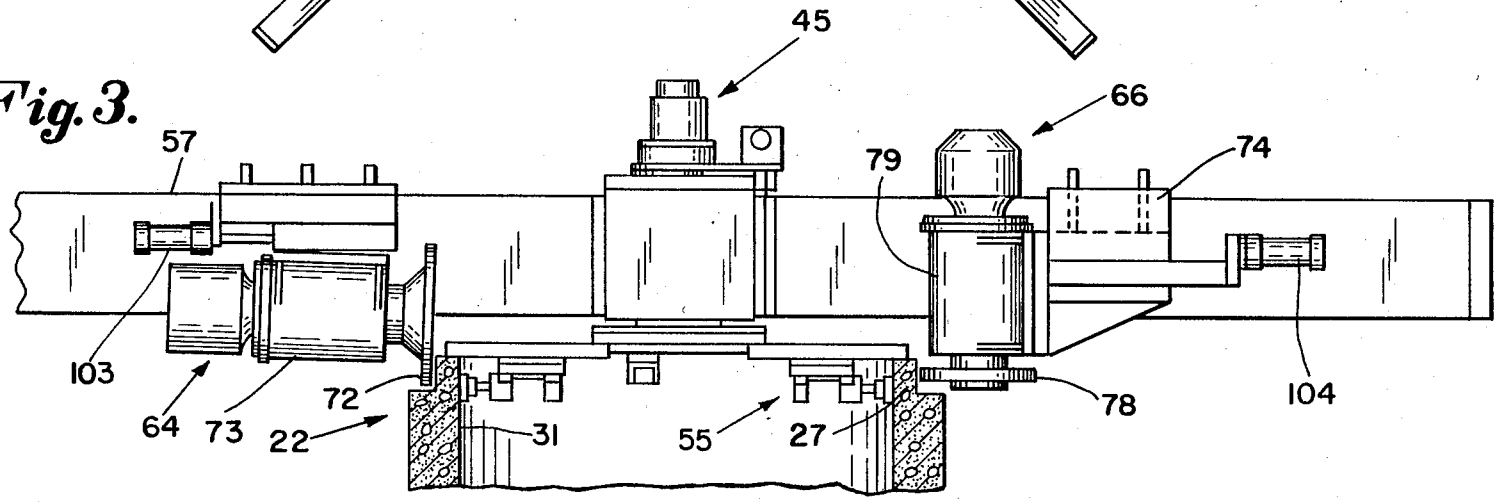
FIG. 3 is a side elevation in section on line 2—2 of the apparatus shown in FIG. 2.
Figure 4:
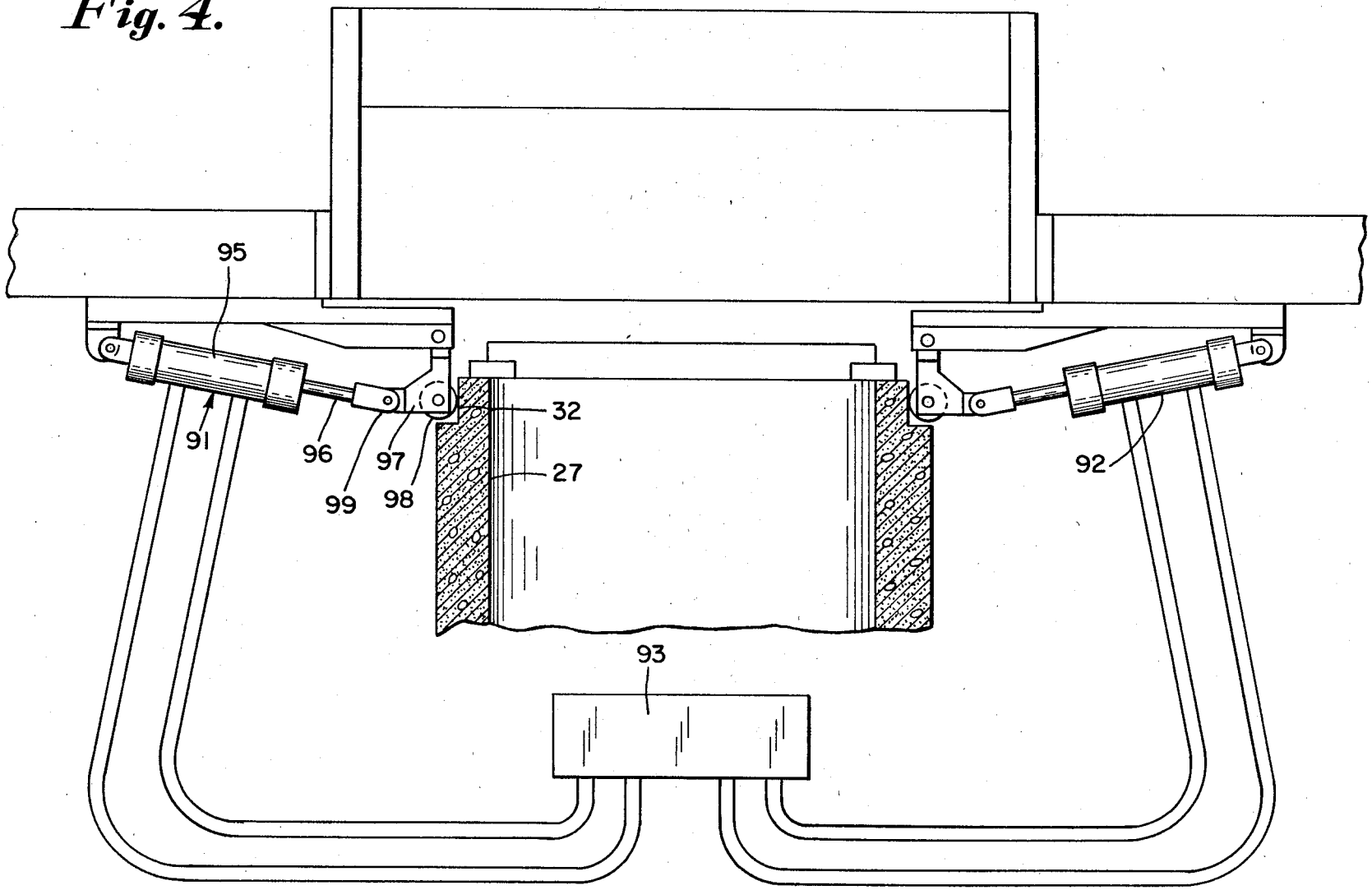
FIG. 4 is an enlarged side elevation showing the power operated centering means of the invention.

As shown in the FIG. 1, the apparatus 21 of the invention may be applied to a concrete pipe or manhole riser 22, which has been cast in a manner well known in the trade to include, or not include, reinforcing rods 23, in the main body 24, a bell 25, in the lower end 26, and a spigot 27, in the upper end 28.

There are usually no rods 23 in the spigot, and if a sealing groove is attempted to be cast therein, or is attempted to be cut therein, after casting, but with the concrete still uncured and green, both the spigot and its groove may have, or develop, flats, bumps, slumps, or otherwise fail to be precisely circular. The bell on the other hand, is usually supported and tends to remain circular, so that such a spigot will have an inaccurate fit therein, causing leaking or breakage at the bell and spigot joint.

It is, thus advantageous in cost and quality to cut the sealing groove and grind the faces of the riser, or pipe, after casting, and after curing in the hardened concrete material as taught in the above mentioned U.S. Pat. No. 4,109,635 to Rossborough of 1978.

Figure 5:
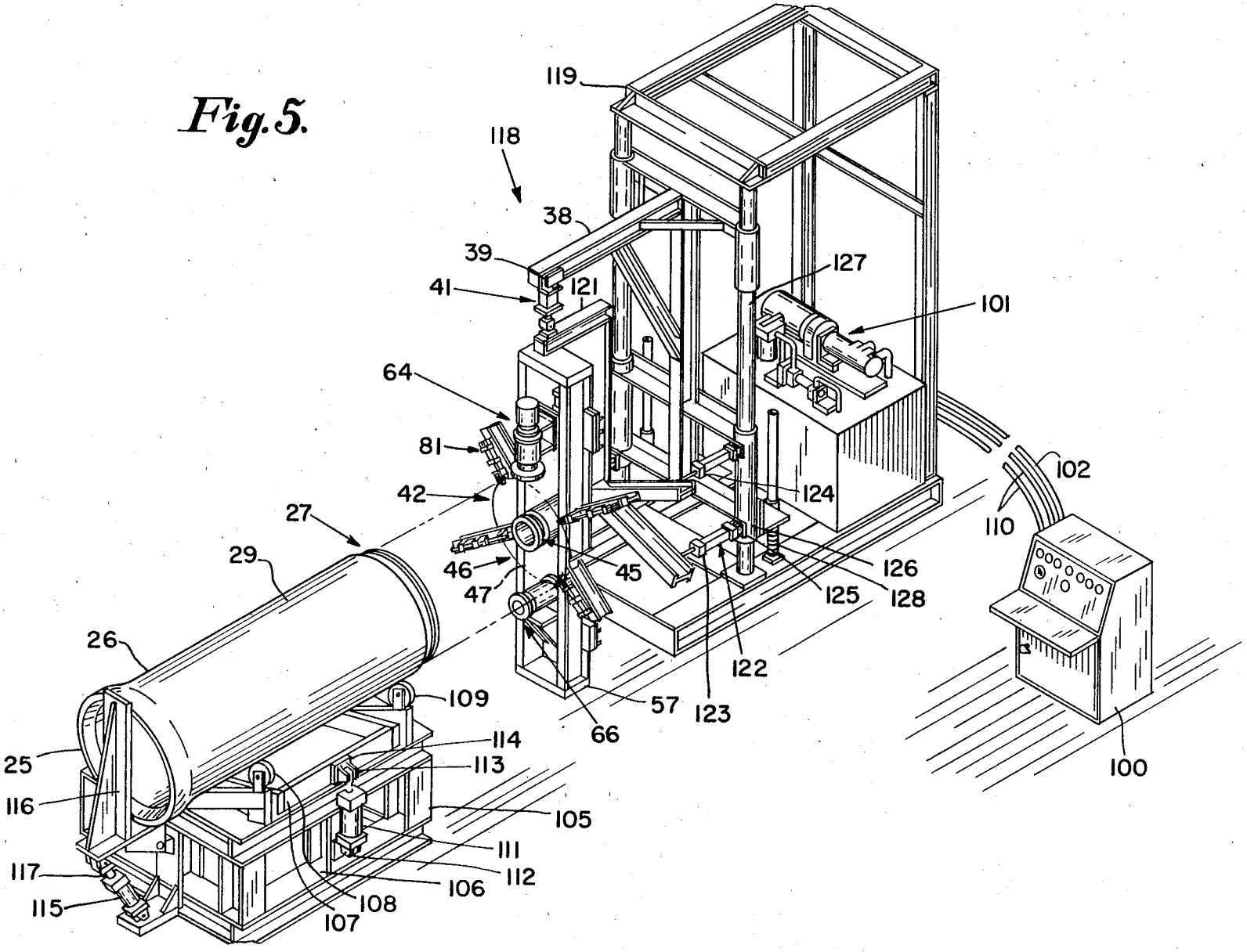
FIG. 5 is a diagrammatic perspective view of the invention applied to a riser or pipe supported horizontally.

The spigot 27, in a bell and spigot type member such as the pipe 22, shown upturned on its lower end 26 in FIG. 1, or such as the similar spigot 27, in a concrete pipe 29, shown recumbent in FIG. 5, includes an inner circumferential face 31, an outer circumferential face 32, and an annular planar diametrical end face 33. The central longitudinal axis of spigot 27 is designated 34, and the spigot may be supported with the axis 34, vertical on a floor 35, on a turntable or on the bed of a truck, if the apparatus 21 is mobile.

It will be understood that the object of the apparatus and method of the invention is to grind the outer face 32 into a true truncated cone, and to cut at least one annular, precise, sealing ring groove around that truncated conical face.

In the apparatus of FIG. 1, which I call the vertical spigot grinder, a frame 36 is provided, including an overhead crane 37, with rail 38, and traveling motorized hoist 39, for suspending, and vertically raising and lowering by means of cylinder 41, the support means 42.

Support means 42, includes the super structure 43, suspended from the piston rod 44, of cylinder 41, the rotational feed motor 45, and a support base 46. Support base 46, includes a circular plate 47, and four radially extending arms 48, 49, 51, and 52, each having a depending integral flange, or foot, such as 53 at the terminal end, arranged to rest on about the center of the end face 33, of the spigot 27, so that there is one such foot and arm in each quadrant around the spigot.

Each of the four arms 48, 49, 51, and 52, has mounted therebelow a fluid actuated cylinder 54, and piston rod 55, the terminal tip 56, of each rod 55, being arranged to move outwardly into clamping contact with the inner face 31, of the pipe 27, when the support base is exactly centered on outer face 32, to lock the support base in centered position.

An elongated main arm assembly 57, is mounted on the support means 42, for rotation therearound by the rotational feed motor 45, the assembly 57, having oppositely disposed radially extending portions 58 and 59, each extending substantially beyond the periphery of the end face 33, of spigot 27, so as to be balanced and symmetrical relative to the axis 34. The main arm assembly is preferably a rectangular frame 61, journalled at the center 62 to the support base and connected by suitable variable gear reduction mechanism to feed motor 45, therebeing an elongated hollow 63 on one side, for the grinding head means 64, and a similar elongated hollow 65 on the opposite side, for the cutter head means 66.

The grinding head means 64 includes a first carriage 67, slidable radially in a first track 68 extending radially on the main arm assembly 57, the first carriage 67 having a second track 69, extending normal to the first track 68 and including a second carriage 71 slidable in the second track and supporting the rotary grinding wheel 72 and its motor 73.

The cutter head means 66 includes a first carriage 74 slidable radially in a first track 75 extending radially on the main arm assembly 57, the first carriage having a second track 76 extending normal to the first track 75, and including a second carriage 77, slidable in the second track and supporting the rotary groove cutter 78 and its motor 79.

Powered centering means 81 is provided, including four centering arms 82, 83, 84, and 85, one in each quadrant around the support base and each extending radially from the main arm assembly. Two pairs such as 86 and 87 of centering sensors 88, 89, 91, and 92 are provided, each sensor mounted on one of the centering arms and the two sensors of each pair, such as 86 or 87, being diametrically opposed at 180° to operate as slave cylinders controlled by one of the pair of master cylinders 93 or 94 to move in equal amounts.

Each sensor 88, 89, 91, or 92 is formed by an hydraulic cylinder 95, piston rod 96, pivoted bracket 97, and contact roller 98 on the free end 99, of rod 96, the roller contacting the outer circumferential face 32 of spigot 27, when the rod 96, is advanced and being pivoted up and out of the way when the rod 96 is retracted.

An hydraulic power unit 101 supplies hydraulic fluid under pressure, through flexible conduit 102 to the hydraulic cylinders 41 of the support means 42, the hydraulic cylinders 54 of the locking clamps 55, the hydraulic cylinders 95 of the centering means, an hydraulic cylinder 103 for advancing and retracting the rotary grinding wheel 72 and motor 73, and a hydraulic cylinder 104 for advancing and retracting the rotary groove cutter 78 and motor 79.

A control console 100 is also provided connected by cables 110, to the apparatus 21 for synchronizing the operation of the apparatus, so that it is automatic and will repeat its cycle of centering, clamping, retracting the centering sensors, advancing the grinder and groover simultaneously, rotating the main arm assembly around the spigot to form a true truncated cone on the outer face and a precise sealing groove in the face and then retract the groover, cutter and clamps to raise the assembly ready for the next riser.

As shown in FIG. 5, the same apparatus and method can be applied to a bell and spigot member such as the pipe 29, which may be of cement, clay, or any other suitable material capable of formation into a bell and spigot type member with spigot 27 at one end, and bell 25 at the other end.

The pipe work stand 105 supports the pipe 29, in horizontal, or recumbent, fixed position, and includes the frame 106 and a cradle 107, having rollers 108 and 109. A pipe transfer cylinder and piston unit 111, has one end 112, affixed to frame 106, and the other end 113 affixed to the tilt frame 114, so that when hydraulically energized it will dislodge a pipe from the cradle, sidewise, for substitution of another pipe into the cradle. A pipe locater element 115 includes an upstanding post 116, longitudinally slidable on frame 106 by pipe locater cylinder and piston unit 117, to permit the spigot 27 of pipe 29 to be firmly supported against movement when longitudinally positioned in cradle 107, or to be moved toward the grinding apparatus 118 of the invention.

The grinding apparatus 118 is similar to grinding apparatus 21 in being mounted on a frame 119, which supports a rail 38, for a hoist 39 and cylinder 41, there being a frame piece 121 by which the support means 42, support plate 47, and main arm assembly 57 are suspended in a vertical plane to float, rather than to hang down by gravity in a horizontal plane, as in FIG. 1. The grinding head means 64, the cutter head means 66, and the centering means 81, are identical with those described above, and operate in the same manner.

However, instead of clamping, or locking means consisting of radially movable rods 55 in each quadrant contacting the inner face 31, of the spigot, to permit the centering sensors to be retracted, in the embodiment of FIG. 5, the clamping, or locking means 122, comprises four hydraulic cylinder and piston units, such as shown at 123 and 124, each in one of the quadrants around the support base plate 47. Each unit such as 123 or 124 has its cylinder base 125, pivoted to one sleeve 126, on one of the vertical posts 127 of frame 119. A pair of screw jacks, such as at 128, permit the entire apparatus 118 to be raised and lowered to locate the support plate 47 in alignment with the pipe 29, the plate 47 being one of a plurality of plates each of predetermined diameter to fit on the end face 33 of the spigot 27, of the pipe 29.

In the method of operation of the vertical spigot grinder of FIG. 1, or the horizontal spigot grinder of FIG. 5, the first step is to adjust the grinding unit and the cutting unit on the main arm assembly, adjust the centering mechanism on the centering arms and to change the support base to fit on the end of the riser, or pipe to be ground.

Figure 7:
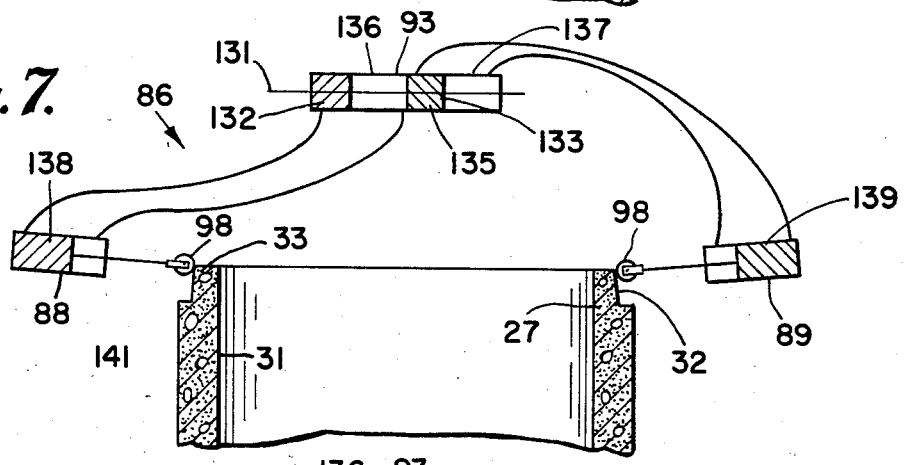

The next step is to activate the synchronized centering cylinders, as illustrated diagrammatically in FIG. 7, to advance the grinding machine assembly toward the pipe or riser end face. The centering cylinders will automatically center the grinding machine relative to the outer circumferential face to be ground, during the approach or just as the approach is completed.

In the vertical type, when the support base is exactly centered, the centering sensors are retracted out of the way while the clamping rods advance outwardly into firm contact with the inner face of the spigot. In the horizontal type, the support base is firmly clamped against the end face of the spigot by the hydraulic units 123, 124 working against the upstanding post 116, with the pipe 29 therebetween, so that the centering sensors may be retracted out of the way.

The grinding and cutting motors are then started so that the diamond grinding wheels move inwardly to previously adjusted diameters, and are ready to grind the outer circumferential face 32, of spigot 27, into a true truncated cone, and to cut an annular sealing ring groove of uniform dimensions in the face 32.

The rotational feed motor 45, is then started to rotate the main arm assembly one full turn around the support base, the feed stopping automatically after grinding 365° and reversing 5° to start position so as to allow a cutting overlap. The grinder and cutter stop automatically and retract to the outer position.

The clamping means in the form of rods 55, or piston and cylinder units 123 and 124, then retract and the grinding machine retracts from the spigot 27 so that the machine may be made ready for the next riser or pipe.

The synchronized master and slave, tandem cylinder, operation of the automated powered centering means 81, of the invention is illustrated in FIGS. 6–9.

Figure 6:
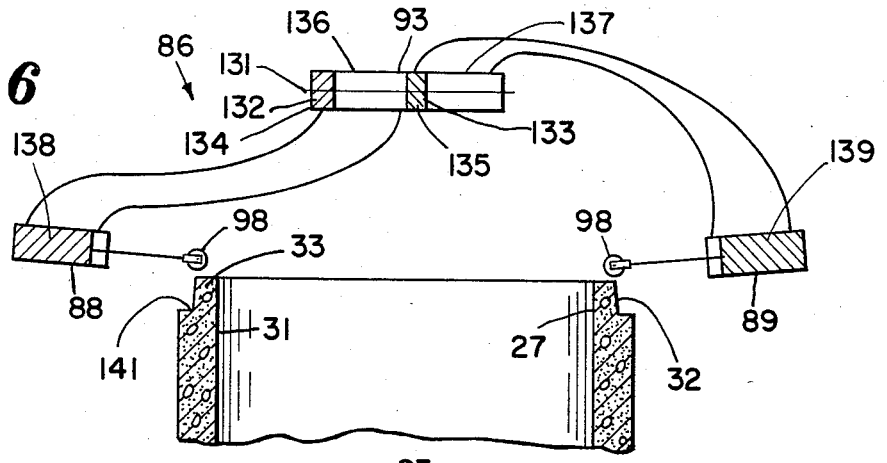
FIGS. 6, 7, 8, and 9 are diagrammatic views of the master and slave fluid synchronization of the centering means of the invention.

In FIG. 6, the tandem, or master cylinder 93, is shown with its common piston rod 131 and tandem piston heads 132 and 133, over to the left, close to the ends 134 and 135 of the respective cylinders 136 and 137, so that the hydraulic fluid 138 and 139 fills the slave cylinders 88 and 89 to move the sensor rollers 98 into full inward position.

In FIG. 7 the pistons 41, and 42, of slave cylinders 88, and 89, have been moved outwardly in equal increments balanced by the tandem piston head movement in tandem cylinders 136, and 137, to center the support base on the outer circumferential face 32, as the rollers travel down face 32.

Figure 8:
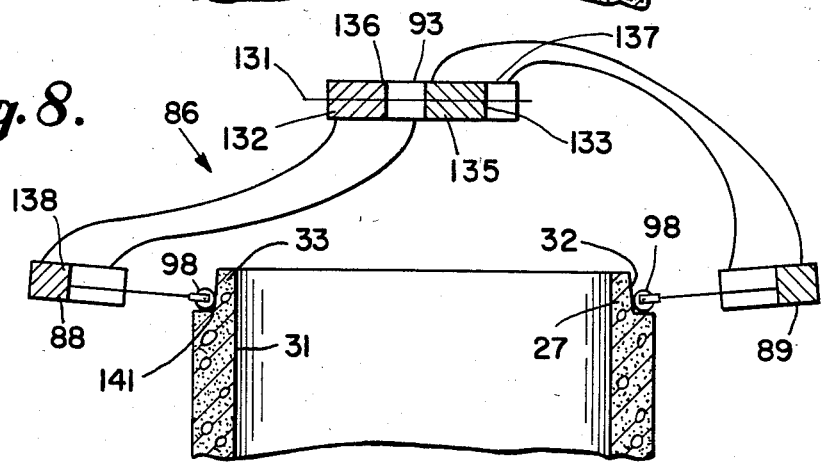

In FIG. 8, the rollers 98 have reached the annular shoulder 141, of the spigot 27, having centered the support base on the end face 33.

Figure 9:
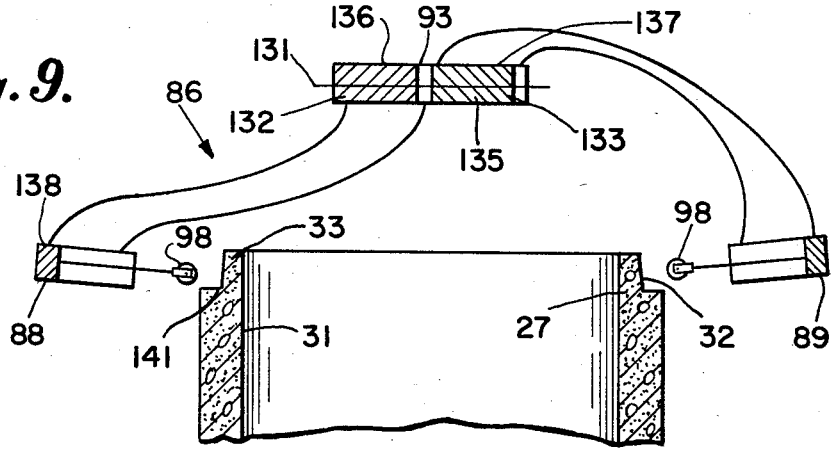

In FIG. 9, the clamping means has taken over to firmly hold the support base in centered position against the end face so that the centering mechanism can be retracted out of the way of the face grinding and groove cutting operation.

By centering the grinding apparatus on the outer face of the spigots of pipes and risers, and machining the spigots after manufacture and curing, the following advantages are achieved.

(1) Pipe production can be increased up to 20% when the sealing ring groove can be eliminated when casting the pipe.

(2) A sealing ring finished groove diameter is guaranteed to tolerances previously unavailable.

(3) The diameter of the spigot outer face can be guaranteed not to exceed tolerances, so that it will correctly fit in the bell of the next adjacent member.

(4) The accurate fit of every bell and spigot type member is accomplished so that they will fit together perfectly, and will be free of leaks.

(5) Double sealing ring grooves, or other configurations, are easily achieved if desired.

(6) All operations are electro-hydraulically controlled from the control console.

(7) Over-all costs are decreased while quality is increased.

The apparatus and method of this invention is equally useful in grinding the inside face of a bell and cutting an O ring groove therearound by reversing the parts to operate from the inside outwardly rather than from the outside inwardly.

I claim:

1. Apparatus for grinding the outer circumferential face of the spigot of a bell and spigot type member, such as a pipe, or manhole riser, into a true truncated cone and for cutting a sealing ring groove around said face, said member having a central, longitudinal axis, and said spigot having an inner circumferential face, and an annular, planar, diametrical end face, said apparatus comprising:

a frame;

support means including a support base suspended from said frame and mounted to be moved relative to said frame and member into position across the said end face of said member in a plane, substantially normal to the central longitudinal axis of said member, and in parallelism with the plane of said end face thereof, and mechanism for moving said support base;

an elongated main arm assembly mounted on said support means for rotation, relative to said support base, and having opposite radial portions, each extending substantially beyond said end face;

powered centering means, including four centering arms, each extending radially from said main arm assembly, in one of the four quadrants therearound, and two pairs of diametrically opposed sensors, each sensor mounted on one of said arms to move radially inwardly into contact with the outer circumferential face of said spigot to center said support means and power mechanism for moving said sensors inwardly and retracting said sensors outwardly;

grinding head means including a rotary grinding wheel and a motor for driving said wheel, mounted on one of said radially extending portions of said main arm assembly for grinding said outer circumferential face of said spigot into a true truncated cone;

cutter head means, including a rotary groove cutter and a motor for driving said cutter, mounted on the opposite said radially extending portion of said main arm assembly for cutting a sealing ring groove in said outer circumferential face of said spigot;

and drive means on said apparatus for achieving relative rotation between said main arm assembly and said support base to simultaneously grind said face on one side of said spigot, and cut said groove in an annular path around said spigot on the opposite side of said spigot.

2. Apparatus as specified in claim 1 wherein:

said member is upended and said end face is horizontal;

and said apparatus includes a plurality of locking clamps each mounted in one of the quadrants around the support base of said support means and fluid actuated piston and cylinder mechanism for advancing each locking clamp radially outwardly into contact with the inner circumferential wall of said spigot to lock said support base against movement.

3. Apparatus as specified in claim 1 wherein:

said member is supported in recumbent position with said end face vertical;

and said apparatus includes a plurality of fluid actuated piston and cylinder mechanisms, each mounted in one of the four quadrants around the axis of said member and adapted to clamp said support base firmly against said end face during rotation and then to retract said support base therefrom.

4. Apparatus as specified in claim 1 wherein:

said cutter head includes a first carriage slidable radially in first tracks extending radially on said main arm assembly, said first carriage having second tracks extending normal to said first tracks and includes a second carriage slidable in said second tracks and supporting said rotary groove cutter and motor.

5. Apparatus as specified in claim 1 wherein:

said grinding head means includes a first carriage slidable radially in first track extending radially on said main arm assembly, said first carriage having second tracks extending normal to said first tracks and includes a second carriage slidable in said second tracks and supporting said rotary grinding wheel and motor.

6. Apparatus as specified in claim 1 wherein:

the two sensors of each pair of sensors are oppositely disposed at 180° to each other and each comprises a hydraulic cylinder, a piston rod slidable in the cylinder, and a roller on the free terminal end of the rod for rolling contact with the outer circumferential face of the spigot;

and said centering means includes a pair of hydraulic master cylinders, each master cylinder operably connected to the two cylinders of one of the pairs of said sensors as slave cylinders, each said master cylinder causing each slave cylinder to move an equal amount.

7. The method of grinding the outer circumferential face of the spigot of a bell and spigot type member and cutting a sealing groove therein by means of a support base, a main arm assembly rotatable on said support base, and centering means, grinding means and cutter means on the main arm assembly which comprises the steps of:

suspending the support base from a frame;

moving said support base and main arm assembly into contact with the end face of said member and centering by means of radially extending centering arms with sensors thereon, the longitudinal axis of said base and assembly relative to the outer circumferential face of the spigot of said member;

moving said grinding means and said cutting means toward each other on said assembly until they are in position to grind a true truncated conical face on, and an annular sealing groove in, said outer circumferential face of said spigot;

and then driving said grinding means and said cutting means while rotating said main arm assembly around said support base for at least one complete revolution around said member.

8. A method as specified in claim 7, plus:

the step of power clamping said support base onto a portion of the end of said member, to assure against rotation thereof prior to the step of rotating said main arm assembly.

9. A method as specified in claim 7 wherein:

said step of centering said support base and main arm assembly on the end face of said member is performed as the said base and assembly approaches the said end face so that the base and assembly are centered relative to the outer circumferential face of the spigot before final seating thereof on said end face.

* * * * *